US009238958B2

(12) United States Patent
Teodorescu

(10) Patent No.: US 9,238,958 B2
(45) Date of Patent: Jan. 19, 2016

(54) DRILL BIT WITH RATE OF PENETRATION SENSOR

(75) Inventor: Sorin G. Teodorescu, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 467 days.

(21) Appl. No.: 12/557,004

(22) Filed: Sep. 10, 2009

(65) Prior Publication Data

US 2011/0060527 A1 Mar. 10, 2011

(51) Int. Cl.

| | |
|---|---|
| ***G01V 3/08*** | (2006.01) |
| ***G01V 3/12*** | (2006.01) |
| ***G01V 3/18*** | (2006.01) |
| ***G01V 3/26*** | (2006.01) |
| ***E21B 45/00*** | (2006.01) |
| ***E21B 47/01*** | (2012.01) |

(52) U.S. Cl.
CPC ..... *E21B 45/00* (2013.01); *E21B 47/01* (2013.01)

(58) Field of Classification Search
CPC ..... E21B 45/00
USPC ..... 702/6, 7, 9–11, 48, 179, 181, 182; 73/152.03; 175/40
See application file for complete search history.

(56) References Cited

U.S. PATENT DOCUMENTS 5,160,925 A * 11/1992 Dailey et al. ..... 340/853.3
5,237,539 A * 8/1993 Selman ..... 367/69
5,415,030 A 5/1995 Jogi et al.
5,448,227 A 9/1995 Orban et al.
5,475,309 A 12/1995 Hong et al.
5,581,024 A * 12/1996 Meyer et al. ..... 73/152.03
5,679,894 A * 10/1997 Kruger et al. ..... 73/152.03
5,720,355 A 2/1998 Lamine et al.
6,057,784 A 5/2000 Schaaf et al.
6,150,822 A 11/2000 Hong et al.
6,230,822 B1 5/2001 Sullivan et al.
6,247,542 B1 * 6/2001 Kruspe et al. ..... 175/40
6,347,282 B2 * 2/2002 Estes et al. ..... 702/6
6,408,953 B1 * 6/2002 Goldman et al. ..... 175/39
6,419,032 B1 7/2002 Sullivan et al.
6,467,341 B1 * 10/2002 Boucher et al. ..... 73/152.43
6,540,033 B1 4/2003 Sullivan et al.
6,543,312 B2 4/2003 Sullivan et al.
6,564,883 B2 5/2003 Fredericks et al.
6,571,886 B1 6/2003 Sullivan et al.
6,626,251 B1 9/2003 Sullivan et al.

(Continued)

OTHER PUBLICATIONS

Dateline Los Almos, A Monthly Publication of Los Almos National Laboratory, January Issue 1997, pp. 1-8.

(Continued)

*Primary Examiner* — Eliseo Ramos Feliciano
*Assistant Examiner* — Felix Suarez
(74) *Attorney, Agent, or Firm* — Cantor Colburn LLP

(57) ABSTRACT

An apparatus for estimating a rate-of-penetration of a drill bit is provided, which in one embodiment includes a first sensor positioned on a drill bit configured to provide a first measurement of a parameter at a selected location in a formation at a first time, and a second sensor positioned spaced a selected distance from the first sensor to provide a second measurement of the parameter at the selected location at a second time when the drill bit travels downhole. The apparatus may also include a processor configured to estimate the rate-of-penetration using the selected distance and the first and second times.

21 Claims, 4 Drawing Sheets

(56) References Cited

U.S. PATENT DOCUMENTS

| | | | | |
|---|---|---|---|---|
| 6,769,497 | B2 | 8/2004 | Dubinsky et al. | |
| 6,850,068 | B2 | 2/2005 | Chemali et al. | |
| 7,046,165 | B2 | 5/2006 | Beique et al. | |
| 7,058,512 | B2 | 6/2006 | Downton | |
| 7,066,280 | B2 | 6/2006 | Sullivan et al. | |
| 7,207,215 | B2 | 4/2007 | Spross et al. | |
| 7,278,499 | B2 | 10/2007 | Richert et al. | |
| 7,301,473 | B2 * | 11/2007 | Shah et al. | 340/854.4 |
| 7,308,937 | B2 | 12/2007 | Radford et al. | |
| 7,350,568 | B2 | 4/2008 | Mandal et al. | |
| 7,387,177 | B2 | 6/2008 | Zahradnik et al. | |
| 7,497,276 | B2 | 3/2009 | Pastusek et al. | |
| 7,506,695 | B2 | 3/2009 | Pastusek et al. | |
| 7,510,026 | B2 | 3/2009 | Pastusek et al. | |
| 2001/0054514 | A1 | 12/2001 | Sullivan et al. | |
| 2002/0195276 | A1 | 12/2002 | Dubinsky et al. | |
| 2003/0209365 | A1 | 11/2003 | Downton | |
| 2004/0069539 | A1 | 4/2004 | Sullivan et al. | |
| 2004/0222018 | A1 | 11/2004 | Sullivan et al. | |
| 2006/0272859 | A1 | 12/2006 | Pastusek et al. | |
| 2008/0060848 | A1 | 3/2008 | Pastusek et al. | |
| 2008/0065331 | A1 | 3/2008 | Pastusek et al. | |
| 2008/0066959 | A1 | 3/2008 | Pastusek et al. | |

OTHER PUBLICATIONS

Semiconductor-Based Radiation Detectors, http://sensors.lbl.gov/sn_semi.html, pp. 1-5.

NETL: Oil & Natural Gas Projects, Harsh-Environment Solid-State Gamma Detector for Down-hole Gas and Oil Exploration, http://www.netl.doe.gov/technologies/oil-gas/NaturalGas/Projects_n/ . . . , pp. 1-5.

XRF Corporation, About CZT Detectors, http://xrfcorp.com/technology/about_czt_detectors.html, 1 sheet.

Dateline Los Almos, a Monthly Publication of Los Almos National Laboratory, Jan. Issue 1997, pp. 1-8.

NETL: Oil & Natural Gas Projects, Harsh-Environment Solid-State Gamma Detector for Down-hole Gas and Oil Exploration, http://xrfcorp.com/technology/about_czt_detectors.html, pp. 1-5.

* cited by examiner

DRILL BIT WITH RATE OF PENETRATION SENSOR

BACKGROUND INFORMATION

1. Field of the Disclosure

This disclosure relates generally to drill bits including sensors for providing measurements for a property of interest of a formation and systems using such drill bits.

2. Brief Description of the Related Art

Oil wells (wellbores or boreholes) are drilled with a drill string that includes a tubular member having a drilling assembly (also referred to as the bottomhole assembly or "BHA") that has a drill bit attached to the bottom end of the BHA. The drill bit is rotated to disintegrate the earth formations to drill the wellbore. The BHA typically includes devices for providing information about parameters relating to the behavior of the BHA, parameters of the formation surrounding the wellbore and parameters relating to the drilling operations. One such parameter is the rate of penetration (ROP) of the drill bit into the formation.

A high ROP is desirable because it reduces the overall time required for drilling a wellbore. ROP depends on several factors including the design of the drill bit, rotational speed (or rotations per minute or RPM) of the drill bit, weight-on-bit type of the drilling fluid being circulated through the wellbore and the rock formation. A low ROP typically extends the life of the drill bit and the BHA. The drilling operators attempt to control the ROP and other drilling and drill string parameters to obtain a combination of parameters that will provide the most effective drilling environment. ROP is typically determined based on devices disposed in the BHA and at the surface. Such determinations often differ from the actual ROP. Therefore, it is desirable to provide an improved apparatus for determining or estimating the ROP.

SUMMARY

In one aspect, a drill bit is disclosed that in one embodiment may include a first sensor positioned on the drill bit configured to provide a first measurement of a parameter at a selected location in a formation at a first time, and a second sensor positioned a selected distance from the first sensor to provide a second measurement of the parameter at the selected location at a second time when the drill bit travels downhole. The drill bit may also include a processor configured to estimate the rate-of-penetration using the selected distance and the first and second times.

In another aspect, a method for estimating a rate-of-penetration of a drill bit in a wellbore is provided that in one embodiment may include: identifying a selected characteristic at a selected location of a formation surrounding a wellbore at a first time using measurements of a first sensor on the drill bit; identifying the selected characteristic at the selected location at a second time using measurements of a second sensor on the drill bit; and estimating the rate-of-penetration for the drill bit based on a distance between the first sensor and second sensor, the first time and the second time.

Examples of certain features of a drill bit having a displacement sensor are summarized rather broadly in order that the detailed description thereof that follows may be better understood. There are, of course, additional features of the drill bit and systems for using the same disclosed hereinafter that form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DETAILED DESCRIPTION

Figure 1:
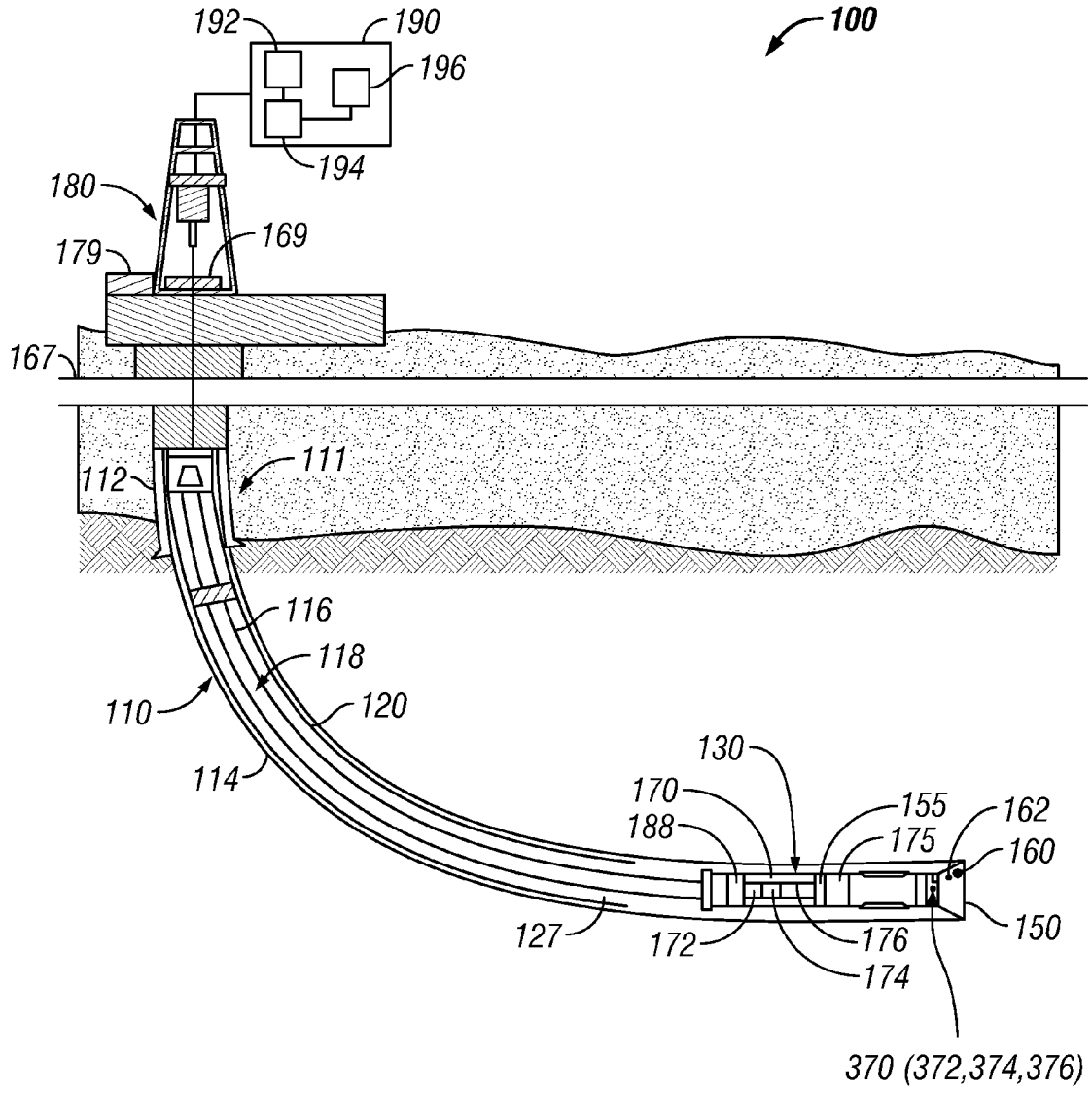
FIG. 1 is a schematic diagram of an exemplary drilling system that includes a drill string having a drill bit and sensors according to one embodiment of the disclosure.

FIG. 1 is a schematic diagram of an exemplary drilling system 100 that may utilize drill bits and monitoring systems disclosed herein for drilling wellbores. FIG. 1 shows a wellbore 110 that includes an upper section 111 with a casing 112 installed therein and a lower section 114 being drilled with a drill string 118. The drill string 118 is shown to include a tubular member 116 carrying BHA 130 at its bottom end. The tubular member 116 may be formed by joining drill pipe sections or it may be composed of a coiled-tubing. A drill bit 150 is attached to the bottom end of the BHA 130 to disintegrate rocks in the earth formation to drill the wellbore 110.

The drill string 118 is shown conveyed into the wellbore 110 from a rig 180 at the surface 167. The rig 180 shown is a land rig for ease of explanation. The apparatus and methods disclosed herein may also be utilized when an offshore rig (not shown) is used. A rotary table 169 or a top drive (not shown) coupled to the drill string 118 may be utilized to rotate the drill string 118 at the surface, which rotates the BHA and thus the drill bit 150 to drill the wellbore 110. A drilling motor 155 (also referred to as "mud motor") in the drilling assembly may be utilized alone to rotate the drill bit 150 or to superimpose the drill bit rotation by the rotary table 169. A control unit (or "controller") 190, which may be a computer-based unit, may be placed at the surface for receiving and processing data transmitted by the sensors in the drill bit and BHA 130 and for controlling selected operations of the various devices and sensors in the BHA 130. The surface controller 190, in one embodiment, may include a processor 192, a data storage device (or "computer-readable medium") 194 for storing data and computer programs 196. The data storage device 194 may be any suitable device, including, but not limited to, a read-only memory (ROM), random-access memory (RAM), flash memory, magnetic tape, hard disk and an optical disk. During drilling, a drilling fluid from a source thereof 179 is pumped under pressure through the tubular member 116, which fluid discharges at the bottom of the drill bit 150 and returns to the surface via the annular space 127 (also referred as the "annulus") between the drill string 118 and the inside wall of the wellbore 110.

Figure 2:
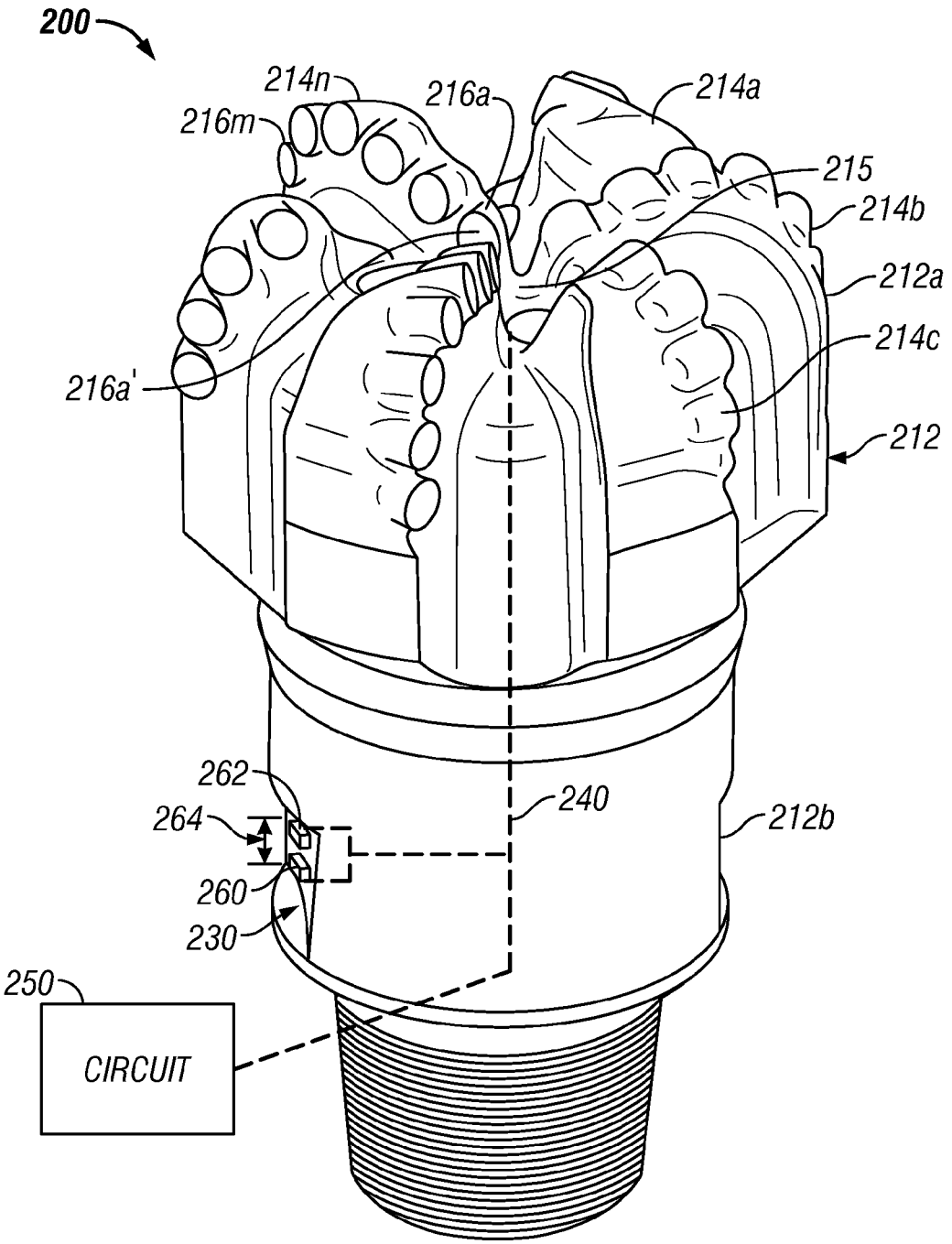
FIG. 2 is an isometric view of an exemplary drill bit showing placement of sensors on the drill bit and an electrical circuit that may process signals from the sensors, according to one embodiment of the disclosure.
Figure 3:
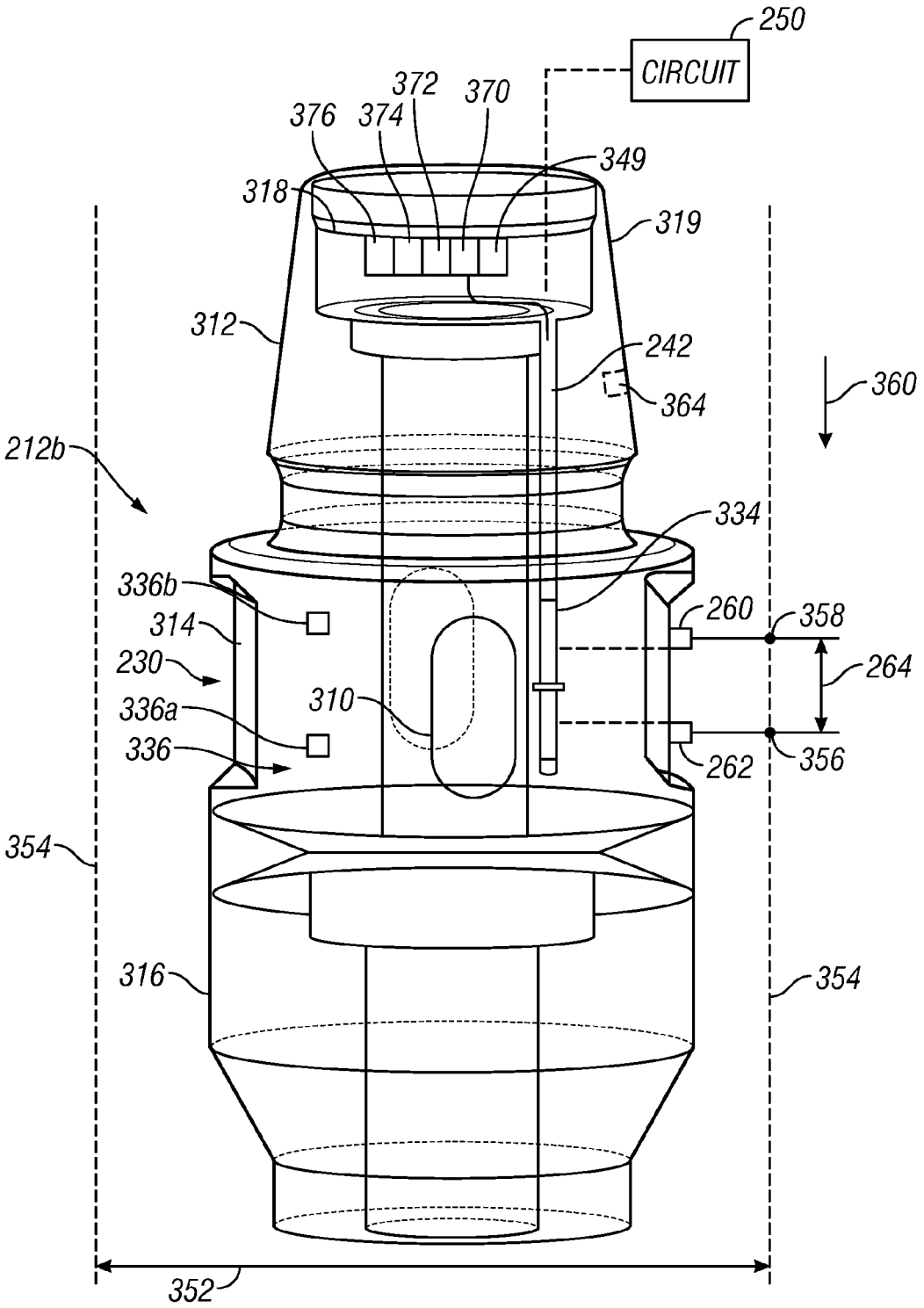
FIG. 3 is an isometric view of a portion of the exemplary drill shown in FIG. 2 depicting hidden lines to show certain inner portions of the shank and pin sections of the drill bit and placement of sensors, measurement circuitry and hardware therein, according to one embodiment of the disclosure.

Still referring to FIG. 1, the drill bit 150, in one embodiment, may include sensors 160 and 162, circuitry for processing signals from such sensors and for estimating one or more parameters relating to the drill bit 150 or drill string during drilling of the wellbore 110, as described in more detail in reference to FIGS. 2 and 3. In an aspect, the sensors 160 and 162 may be located on a bit body, such as a shank, configured to determine a rate of penetration (ROP) of the drill bit 150. The BHA 190 further may include one or more downhole sensors (also referred to as the measurement-while-drilling (MWD) sensors), collectively designated herein by numeral 175, and at least one control unit (or controller) 170 for processing data received from the MWD sensors 175, sensors 160 and 162, and other sensors in the drill bit 150. The controller 170 may include a processor 172, such as a microprocessor, a data storage device 174 and programs 176 for use by the processor 172 to process downhole data and to communicate with the surface controller 190 via a two-way telemetry unit 188.

In an aspect, a controller 370 may be positioned on the drill bit 150 to process signals from the sensors 160 and 162 and other sensors in the drill bit. As discussed in detail with reference to FIGS. 2-5, the controller 370 may be configured to be placed in the drill bit at surface pressure proximate to the sensors 160 and 162. Such a configuration is desirable as it can reduce signal degradation and enables the controller to process sensor signals faster compared to the processing of sensor signals by a controller in the BHA, such as controller 170. The controller 370 may include a processor 372, such as a microprocessor, a data storage device 374 and programs 376 for use by the processor 372 to process downhole data and to communicate with the controllers 170 in the BHA and surface controller 190.

FIG. 2 shows an isometric view of an exemplary PDC drill bit 200 made according to one embodiment of the disclosure. In one configuration, the drill bit 200 may include sensors 260 and 262 for obtaining measurements relating to ROP of the drill bit 200 and certain circuits for processing at least partially the signals generated by such sensors. A PDC drill bit is shown for the purpose of explanation only. Any type of drill bit, including, but not limited to, roller cone bit and diamond bit, may be utilized for the purpose of this disclosure. The drill bit 200 is shown to include a bit body 212 that comprises a crown 212*a* and a shank 212*b*. The crown 212*a* is shown to include a number of blade profiles (or profiles) 214*a*, 214*b* . . . 214*n*. All profiles (214*a*, 214*b* . . . 214*n*) terminate proximate to the bottom center 215 of the drill bit 200. A number of cutters are shown placed along each profile. For example, profile 214*a* is shown to contain cutters 216*a*-216*m*. Each cutter has a cutting element, such as the element 216*a*' corresponding to the cutter 216*a*. Each cutting element engages the rock formation when the drill bit is rotated to drill the wellbore. Each cutter has a back rake angle and a side rake angle that defines the cut made by that cutter into the formation.

Still referring to FIG. 2, in one embodiment the sensors 260 and 262 may be placed in a recessed portion 230 of the shank 212*b*. The sensors 260 and 262 are spaced a selected distance 264 from each other along a longitudinal axis 240 of the drill bit 200, enabling each sensor to take measurements at different locations (or depths) in the wellbore. The sensors 260 and 262 may be located at any suitable position in the drill bit 200, such as the bit body 212 or bit shank 212*b*. In one aspect, sensor 260 and 262 may protrude from or be coupled to the surface of the drill bit body, thereby enabling the sensors 260 and 262 to transmit and receive signals from a wall of the formation. In another embodiment the sensors may be placed within the drill bit 200. In each case the sensors are positioned and configured to transmit signals through the fluid in the borehole to the formation and receive signals from the formation responsive to the transmitted signals.

In one aspect, the sensors 260 and 262 may be acoustic sensors using acoustic signals and/or energy for measuring geophysical parameters (e.g., acoustic velocity and acoustic travel time). Further, the sensors 260 and 262 may also detect reflected acoustic waves to identify specific discontinuities in the formation or an acoustic image of the wellbore wall. Illustrative acoustic sensors include acoustic wave sensors that utilize piezoelectric material, magneto-restrictive materials, etc. In addition, each sensor may be a transducer (combination of an acoustic transmitter and acoustic receiver). The transmitter may transmit acoustic signals, such as a signal at high frequency, at a selected wellbore depth and the receiver receives the acoustic waves reflected from the wellbore wall and thus recognizes discontinuities in the formation substantially at the same depth. In other embodiments, the sensors 260 and 262 may measure other parameters, such as resistivity and gamma rays. In another aspect, tracers (magnetic or chemical) may be utilized for determining ROP. Signals from the sensors 260 and 262 may be provided via conductors 240 to a circuit 250 located outside the bit or placed in the drill bit 212*b*. In one aspect, the circuit 250 may be configured to amplify the signals received from the sensors 260 and 262, digitize the amplified signals and transmit the digitized signals to the controller 370 in the drill bit 200 (FIG. 3), controller 170 in the BHA and/or surface controller 190 for further processing. One or more such controllers process the sensor data and estimate the instantaneous ROP from the sensor signals using programs and instructions provided to such controllers, as described in more detail in reference to FIGS. 3 and 4.

FIG. 3 is an isometric view of the shank 212 and pin section 312 of the drill bit 200 shown in FIG. 2, depicting hidden lines to show certain inner portions of the shank 212*b* and pin sections 312 of the drill bit 200, and placement of certain sensors, measurement circuitry and other hardware, according to one embodiment of the disclosure. The shank 212*b* and pin section 312 include a bore 310 therethrough for supplying drilling fluid to the crown 212*a* of the bit 200 (FIG. 2) and one or more longitudinal sections surrounding the bore 310, such as sections 313, 314 and 316. Section 314 includes a recessed portion 230. In addition, the upper end of the shank pin section 312 includes a recessed area 318. A suitable coupling mechanism, such as threads 319 on the pin section 312 (or neck) connect the drill bit 200 to the drilling assembly 130 (FIG. 1). In aspects, sensors 260 and 262 may be placed at any suitable location, including in the recessed portion 230, on the pin region 364, inside 336 of the drill bit or any other location. In the particular embodiment of FIG. 3, sensors 260 and 262 are shown positioned in recess 314 and spaced apart by a distance 264 along the longitudinal direction of the drill bit 200. Conductors 242 and 334 may be run from the sensors 260 and 262 to an electric circuit 349 in the recess 318 via suitable conductors 242 in a recess 334 in the shank 212 and pin section 312. In one aspect, circuit 349 may include signal conditioning circuitry, such as an amplifier that amplifies the signals from the sensors 260 and 262 and an analog-to-digital (A/D) converter that digitizes the amplified signals. The digitized signals are provided to a controller 370 for processing. In one aspect the controller 370 may include a processor 372, data storage device 374 and programs 376 for use by the processor 372 to process signals from sensors 260 and 262. In another aspect, the sensor 260 and 262 may be located along another section of the shank or pin section, such as shown by elements 336*a* and 336*b*, or at any other suitable location. In another configuration, the sensors may be positioned on an outer surface of the shank 212*b*, bit body 212, pin section 312 or other portions of the bit, and the signal conditioning and digitizing elements may be positioned in the shank 212*b*. If the sensing elements are recessed into the shank 212*b* or bit body 212, then a window formed of a media that does not block signals utilized for the measurement, such as acoustic waves, electromagnetic waves and gamma radiations, may be interposed between the sensing element and the surface of the shank 212*b* or bit body 212. In another configuration, the signals from the sensors 260 and 262 may be processed by a circuit 250 (FIG. 2) outside the drill bit 200. The circuit 250 may be controller 170 in the BHA or controller 190 (FIG. 1) at the surface or a combination thereof. The signals from the drill bit 200 may be communicated to the external circuit 250 by any suitable method, including, but not limited to, electrical coupling and acoustic transmission.

In one embodiment, the sensors 260 and 262 may be acoustic sensors configured to transmit acoustic waves at selected frequencies to the formation surrounding the drill bit 200 and to receive acoustic waves from the formation responsive to the transmitted waves. The acoustic sensors (260, 262) may transmit acoustic waves into a wellbore wall 354 at a frequency, wherein the wall 354 will cause a reflection of the waves back to the sensors (260, 262). The sensors 260 and 262 may receive the reflected waves and the controller 370, 190 and/or 170 determines a characteristic of the borehole wall from the reflected signals. In operation (i.e., while drilling), the acoustic sensor 262 transmits a signal at time $T_1$ at depth 356 and the processor (370, 170 and/or 190) determines a specific characteristic (such as an image of the wall of the borehole or the formation) from the received signals. As the drill bit moves in a downhole direction 360, the sensor 260 continually transmits signals at the same frequency as the sensor 262 and receives the acoustic signals that are processed by the processors. When the drill bit has traveled the distance 264 at time $T_2$, the processors may be able to match the characteristic determined using sensors 262 and 260. Accordingly, the controller and processor can calculate an ROP for the drill bit from the elapsed time ($T_2$-$T_1$) and the known distance 264. For example, if the elapsed time ($T_2$-$T_1$) is 20 seconds and the distance (264) is six inches, the ROP (distance over time: six inches/20 seconds) will be 0.3 inches/second. In other embodiments, as discussed below, the apparatus may use the technique described above with any suitable sensors, such as gamma ray sensors, resistivity sensors, and sensors that detect injected chemical, magnetic or nuclear tracers.

In another embodiment, the sensors 260, 262 may use a gamma ray measurement to calculate ROP for the drill bit. The sensors 260, 262 may be configured to utilize gamma ray spectroscopy to determine the amounts of potassium, uranium and thorium concentrations that naturally occur in a geological formation. Measurements of gamma radiation from these elements may be utilized because such elements are associated with radioactive isotopes that emit gamma radiations at characteristic energies. The amount of each element present within a formation may be determined by its contribution to the gamma ray flux at a given energy. Measuring gamma radiation of these specific element concentrations is known as spectral stripping. Spectral stripping refers to the subtraction of the contribution of unwanted elements within an energy window, including upper and lower boundaries, set to encompass the characteristic energy(s) of the desired element within the gamma ray energy spectrum. Because of these factors, spectral stripping may be accomplished by calibrating the tool initially in an artificial formation with known concentrations of potassium, uranium and thorium under standard conditions.

Illustrative devices for detecting or measuring naturally occurring gamma radiation include magnetic spectrometers, scintillation spectrometers, proportional gas counters and semiconductors with solid state counters. For instance, a suitable gamma ray sensor may utilize a sensor element that includes a scintillation crystal and an optically-coupled photomultiplier tube. Output signals from the photomultiplier tube may be transmitted to a suitable electronics package which may include pre-amplification and amplification circuits. The amplified sensor signals may be transmitted to the processor in a controller. In certain embodiments of the disclosure, solid state devices for gamma ray detection may be utilized.

Gamma ray sensors configured to detect naturally occurring gamma ray sources may provide an indication of a lithology or change in lithology in the vicinity of the bit 200. With reference to FIG. 3, sensors 260 and 262 may be gamma ray sensors. In embodiments, at time $T_1$, the signals from the gamma ray sensors 260 and 262 may be used to estimate an energy signature for locations 358 and 356, respectively, within the formation being drilled. Thereafter, at time $T_2$, the detected energy signature for location 356 may be detected by sensor 260. The elapsed time ($T_2$-$T_1$) between signature measurements and distance 264 may correlated and processed to determine ROP for the drill bit.

In yet another configuration, the sensors 260 and 262 may be resistivity sensors that provide an image or map of structural features of the formation. The image of selected locations with sensor 262 at time $T_1$ and the same image determined by sensor 260 at time $T_2$ taken the known distance 264 apart may be utilized to determine ROP of the drill bit, as described above with respect to the acoustic signals.

Figure 4:
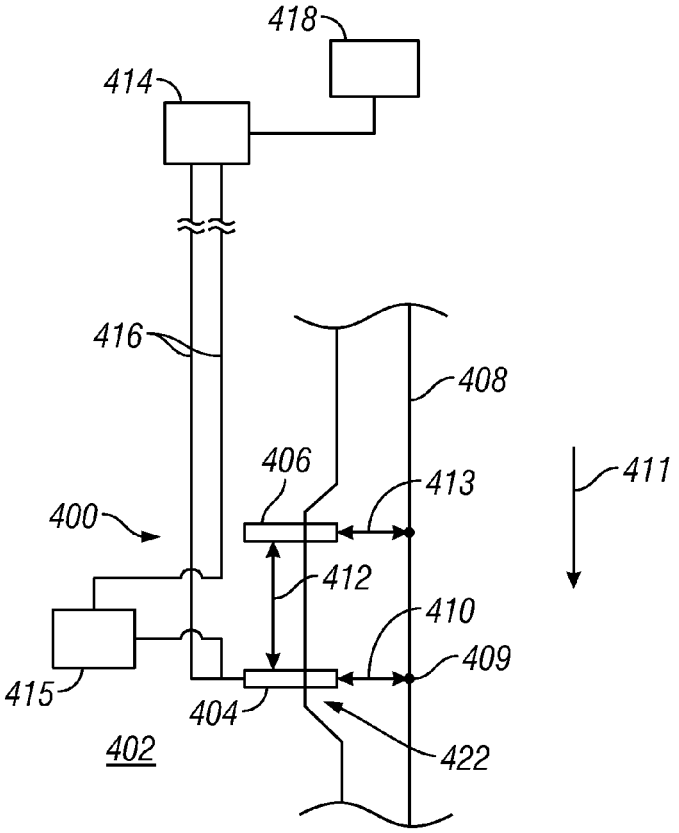
FIG. 4 is a sectional side view of a pin portion of the exemplary drill bit showing inner portions of the pin portion, a controller and other measurement hardware in the drill bit, according to one embodiment of the disclosure.

FIG. 4 is a schematic view of an embodiment of an ROP measurement system 400. A portion of the system 400 is located in a bit shank 402, where sensors 404 and 406 are chemical tracer sensors. The chemical tracer sensors (404, 406) utilize chemical signatures to identify locations on a wellbore wall 408. For example, tracer sensor 404 may emit a chemical burst 410 that impacts a location 409 on the formation wall 408. In an aspect, the chemical burst 410 creates a chemical signature in the formation at location 409 at time $T_1$. As the bit travels downhole 411, the sensor 406 may detect the chemical signature at location 409 at time $T_2$. Thus, a controller 415 may calculate an ROP based on the time elapsed, $T_2$-$T_1$, and a distance 412 between the sensors 404 and 406. The chemical tracer sensors 404, 406 may be supplied to the chemical by a pump 414, fluid lines 416 and storage receptacle 418. The controller 415, pump 414, fluid lines 416 and storage receptacle 418 may be located at the surface, in the drill string or in the drill bit, depending on the application. In the embodiments discussed, the sensors may both be placed on the shank, pin, cone or crown areas. In other embodiments, the sensors may be in different locations, e.g., one in the shank and one in the crown area, pin, or cone. The important factor for determination of ROP is that the distance between the sensors is known and the time between measurements of a selected location are accurately measured.

Figure 5:
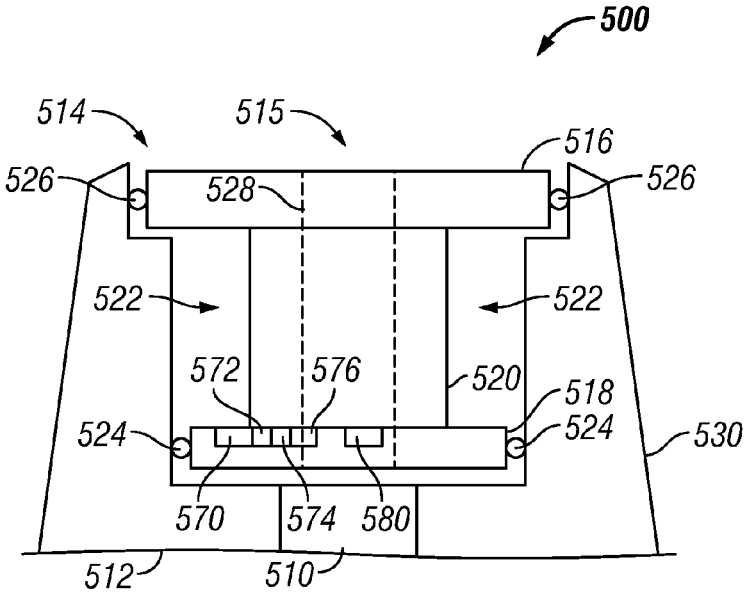
FIG. 5 is a schematic view of an exemplary measurement system that may be used to determine a drill bit ROP, according to one embodiment of the disclosure.

FIG. 5 shows an embodiment of a portion of the neck section 500 that may be utilized to house the electronic circuitry 370 (FIG. 3) at low pressure. The neck section 500 may be the portion of the drill bit opposite the crown or cone section (containing the cutters) and may be coupled to a portion of the drill string via threads, located on surface 530, or other suitable coupling means. The neck portion 500 may include an inner bore 510, a generally circular piece 512 and a recessed area 515. The inner bore 510 may enable communication of drilling fluid, production fluid and routing of various electrical, communication and fluid lines through the drill bit. In one aspect, the recessed area 515 may receive a sealing member 514 that is configured to house de-pressurized components, such as electronics. The sealing member 514 may feature a large flange 516 and a small flange 518 at opposing ends of a cylinder portion 520. The cylinder portion 520 may have a circular open volume or cavity area 522 that may accommodate components that are protected from the increased pressure to which the bit and BHA are exposed downhole.

In an aspect, the sealing member 514 and sealing member cavities are sealed from outside pressure by seals 524 and 526 between the sealing member 514 and circular piece 512. The seals 524 and 526 may be any suitable sealing mechanism, such as an O-ring composed of a rubber, silicone, plastic or other durable sealing composite material. The seals 524 and 526 may be configured to seal the sealing member 514 from up to 20,000 pounds-per-square-inch (psi) of downhole pressure outside the drill bit. Due to the configuration of sealing member 514 and seals 524 and 526, electronic components are protected within the depressurized environment within the sealed area. For example, a controller 570 may be positioned within the sealed portion of the sealing member 514 to process signals from the sensors used to calculate the ROP. The controller 570 may include a processor 572, a data storage device 574 and programs 576 for use by the processor 572 to process downhole data and to communicate with the surface controller 190 (FIG. 1). Other circuitry 580, such as signal conditioning and communication hardware, may also be located within the sealed portion of the sealing member 514. The controller 570 may communicate with the surface and other portions of the drill string by insulated conductive wires (e.g., copper wire), fiber optic cables, wireless communication or other suitable telemetry communication technique. Wires, cable, drilling fluid and/or formation fluid may be routed through a cavity 528 in the sealing member to the drill string. In an aspect, the sealing member 514 and the components within the sealing member enable processing and communication of the measurement signals and data, such as signals from acoustic sensors (260, 262 of FIGS. 2, 3), thereby providing an ROP measurement for the drill bit within the wellbore.

The foregoing description is directed to certain embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. An apparatus for use in drilling a wellbore, comprising:

a first sensor positioned in a drill bit configured to provide a first measurement of a parameter at a selected location in a formation at a first time;

a second sensor positioned in the drill bit a selected distance from the first sensor configured to provide a second measurement of the parameter at the selected location at a second time when the drill bit travels downhole; and a processor configured to: match an image of a wall of the formation determined using the measurements from the first sensor and the measurements from the second sensor, estimate the rate of penetration (ROP) using the selected distance, the first time and the second time and control the rate of penetration.

2. The apparatus of claim 1, wherein at least one of the first sensor and second sensor detects one of: acoustic waves, gamma rays, electromagnetic waves, and a tracer.

3. The apparatus of claim 1, wherein one of the first sensor and second sensor is positioned on one of a shank and a pin section of the drill bit.

4. The apparatus of claim 1, wherein the processor is placed at one of (i) a location in a bottomhole assembly; (ii) a surface location; (iii) a location in the drill bit; and (iv) partially in one of a bottomhole assembly, the drill bit and the surface.

5. The apparatus of claim 1, wherein the processor is configured to process measurements from the first sensor and the second sensor to match a characteristic of a formation and estimate the ROP based on the first time, second time and the selected distance.

6. The apparatus of claim 1, wherein the processor is configured to: match a formation characteristic determined from using the measurements from the first sensor and the measurements from the second sensor and estimate the rate of penetration using the selected distance and the first time and the second time.

7. A method for determining a rate-of-penetration of a drill bit in a wellbore, comprising:

identifying a selected characteristic at a selected location of a formation surrounding a wellbore at a first time using measurements of a first sensor in the drill bit;

identifying the selected characteristic at the selected location at a second time using measurements of a second sensor in the drill bit; and estimating and controlling, by a processor configured to: match an image of a wall of the formation determined using the measurements of the first sensor and the measurements of the second sensor and estimate the rate of penetration using the selected distance, the first time and the second time, the rate-of-penetration for the drill bit based on a distance between the first sensor and second sensor, the first time and the second time.

8. The method of claim 7, wherein the first and second sensors are configured to sense one of: acoustic waves, gamma rays, chemical traces and resistivity.

9. The method of claim 7, wherein the first and second sensors are positioned on one of a shank, a crown and a pin of the drill bit.

10. The method of claim 7, wherein estimating the rate-of-penetration (ROP) for the drill bit comprises using a processor to calculate the ROP of the drill bit.

11. The method of claim 10, wherein the processor is placed at one of a location in the bottomhole assembly, a surface location, a location in the drill bit and partially in the bottomhole assembly and drill bit and partially at the surface.

12. The method of claim 7, further comprising digitizing signals provided by the first and second sensors via a circuit.

13. The method of claim 8, wherein the first sensor is positioned on a shank of the drill bit and the second sensor is positioned on one of a crown and a pin.

14. A system for determining a rate-of-penetration (ROP), comprising:

a bottomhole assembly coupled to an end of a drill string;

a drill bit located in the bottomhole assembly;

a first sensor positioned in the drill bit, wherein the first sensor is configured to identify a first location in a formation at a first time;

a second sensor positioned in the drill bit a distance from the first sensor, wherein the second sensor is configured to identify the first location in the formation at a second time as the drill bit travels downhole; and a processor configured to: match an image of a wall of the formation corresponding to the first location determined from measurements of the first sensor and measurements of the second sensor, estimate the rate of penetration (ROP) using the selected distance, the first time and the second time and control the rate of penetration.

15. The system of claim 14, wherein the processor is placed at one of: a location in the bottomhole assembly, a surface location, partially in the bottomhole assembly, and partially at the surface.

16. The system of claim 14, wherein the first and second sensors are configured to sense one of: acoustic waves, gamma rays, chemical traces and resistivity.

17. The system of claim 14, wherein the first and second sensors are positioned on one of a shank, a crown and a pin of the drill bit.

18. The system of claim 14, wherein the first sensor is positioned on a shank of the drill bit and the second sensor is positioned on one of a crown and a pin.

19. The system of claim 14, further comprising a circuit configured to digitize signals provided by the first and second sensors.

20. A method for determining a rate of penetration of a borehole assembly, comprising:

positioning a first sensor in a drill bit, wherein the first sensor is configured to identify a first location in a formation at a first time; and positioning a second sensor in the drill bit a distance from the first sensor, wherein the second sensor is configured to identify the first location in the formation at a second time as the bit travels downhole and the first and second sensor are coupled to a processor configured to: match an image of a wall of the formation determined using the measurements of the first sensor and the measurements of the second sensor, estimate the rate of penetration using the selected distance, the first time and the second time, wherein the rate-of-penetration for the drill bit is calculated based on the distance, the first time and the second time, and control the rate of penetration.

21. An apparatus for use in drilling a wellbore, comprising:

a first sensor positioned in a drill bit configured to provide a chemical signature at a selected location in a formation at a first time;

a second sensor positioned in the drill bit a selected distance from the first sensor configured to detect the chemical signature at the selected location at a second time when the drill bit travels downhole; and a processor configured to estimate a rate of penetration (ROP) of the drill bit using the selected distance, the first time and the second time, and control the rate of penetration.

* * * * *